United States Patent [19]

Macquire-Cooper

[11] 3,977,575

[45] Aug. 31, 1976

[54] PRESSURIZED CONTAINERS AND METHOD OF MAKING

[76] Inventor: Richard Terence Macquire-Cooper, 3 Burcot Park, Clifton Hampden, near Abingdon, Berkshire, England

[22] Filed: Aug. 27, 1973

[21] Appl. No.: 392,052

[30] Foreign Application Priority Data

Aug. 25, 1972 United Kingdom ..... 39623/72

[52] U.S. Cl. ..... 222/396; 29/451; 29/509; 29/523; 222/402.24

[51] Int. Cl.[2] ..... B65D 83/00

[58] Field of Search ..... 29/422, 428, 450, 451, 29/453, 509, 511, 512, 522, 523, 208 B, 208 D, 213, 157.1 R; 222/204, 394, 396, 397, 402.24, 569; 220/24, 85 V, 89 B, 3, 137, 239

[56] References Cited

UNITED STATES PATENTS

| | | | |
|---|---|---|---|
| 2,687,831 | 8/1954 | Miller | 29/450 UX |
| 2,713,713 | 7/1955 | Tubbs | 29/453 |
| 2,760,691 | 8/1956 | Henchert | 29/450 UX |
| 2,834,521 | 5/1958 | Nyden | 222/569 |
| 2,845,203 | 7/1958 | Potash | 29/451 UX |
| 2,901,144 | 8/1959 | Haustrup | 29/450 UX |
| 2,957,611 | 10/1960 | Sagarin | 222/402.24 |
| 3,223,293 | 12/1965 | Seaquist | 29/451 X |
| 3,450,305 | 6/1969 | Kinnavy et al. | 222/397 X |
| 3,548,564 | 12/1970 | Bruce et al. | 29/509 X |
| 3,620,421 | 11/1971 | MacGuire-Cooper | 222/402.24 X |
| 3,791,561 | 2/1974 | Ewald | 222/396 |
| 3,845,888 | 11/1974 | Focht | 222/402.24 |
| 3,850,339 | 11/1974 | Kinkel | 222/397 X |

*Primary Examiner*—Victor A. DiPalma
*Attorney, Agent, or Firm*—Morris Liss

[57] ABSTRACT

A method of filling a pressurized package, and apparatus therefor, is described in which a unitary valve body is aligned with a container neck, fluid under pressure is introduced through the neck and around the valve and then the valve is forced into the neck to seal the container, the valve having a body portion preformed to engage in a neck portion with interference, including rib and groove engagement, and the neck portion having a smallest diameter to depth ratio no greater than 5:1, and the valve body portion being long enough to extend through the neck to bulge into the container with the internal pressure of the container acting inside the valve to force the valve body portion radially against the neck portion.

12 Claims, 18 Drawing Figures

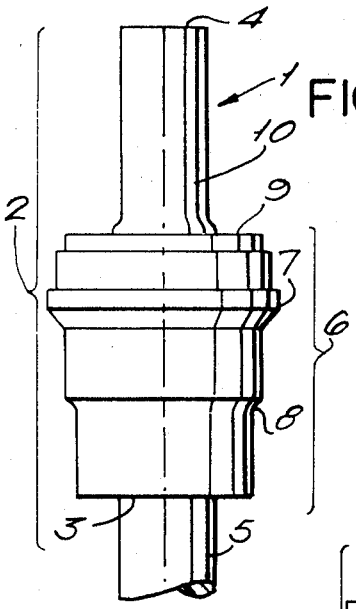
FIG. 1.
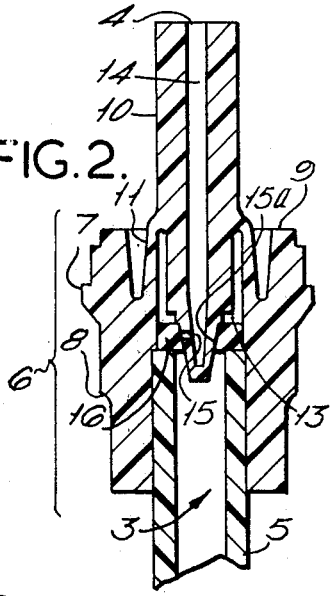
FIG. 2.
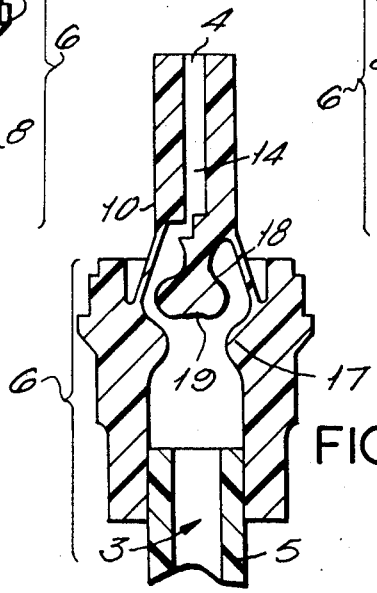
FIG. 3.
FIG. 4.
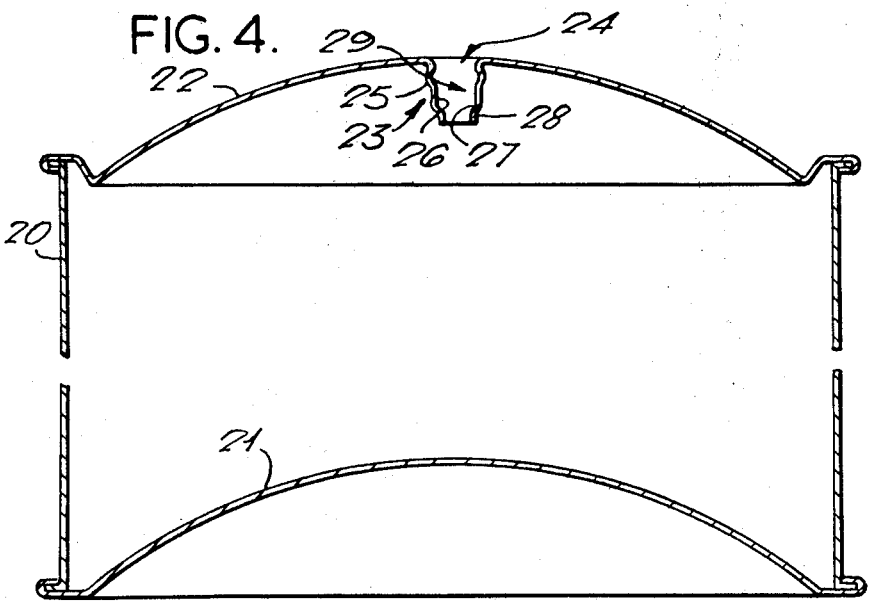

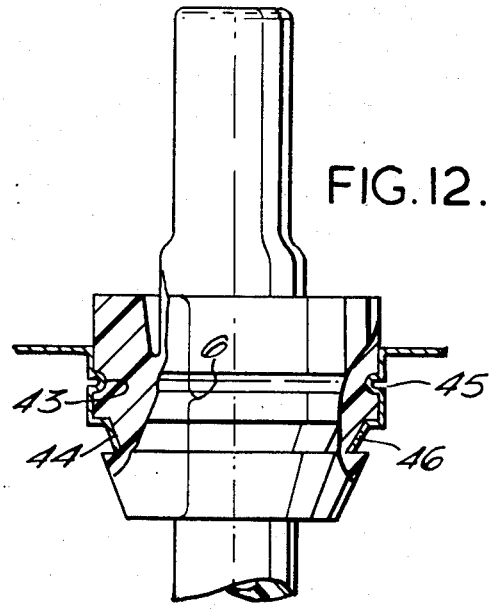
FIG. 12.
FIG. 13.
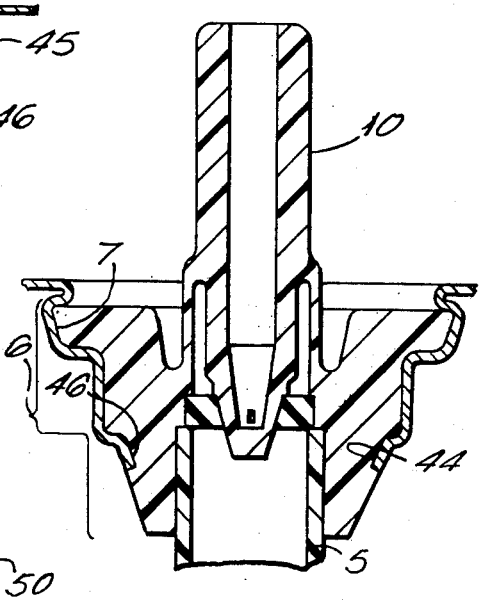
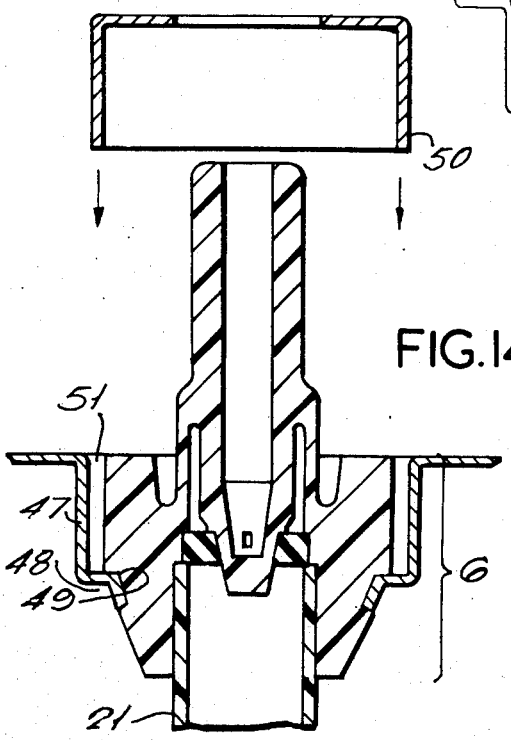
FIG. 14.

PRESSURIZED CONTAINERS AND METHOD OF MAKING

BACKGROUND OF THE INVENTION

The invention relates to pressurized packaging and methods of assembling and filling pressurized packages, e.g. in the field of so-called aerosol dispensers.

At the present time a large number of aerosol dispensers are manufactured and filled by the following established method. A valve is constructed from two plastics pieces, a rubber gasket, a spring and a so-called one-inch (approximately 25 mm) diameter plated metal cup. At the centre of the cup, there is an upstanding neck with a turned-over edge and the plastics pieces, the gasket and the spring are assembled in the neck which is then deformed to retain these parts in sealing engagement to form an operable, normally-closed, valve mechanism. A plastics dip-tube is attached to the inlet end of the mechanism and a gasket is inserted in a turned rim of the cup.

The container for this valve has a one inch (about 25 mm) aperture in one metal end wall and is firstly charged through the aperture with a predetermined amount of the material to be dispensed. The valve with its cup is then located in alignment with the container aperture and a filling apparatus head is placed in sealing contact with the apertured end wall of the container. The container is then purged through its aperture and via the head, after which propellant under pressure is introduced by the head around the cup and through the aperture. When a measured amount of propellant has been supplied, the cup is brought into engagement with the aperture and sealed thereto by a collet in the head deforming the cup wall radially outwardly to hold the gasket in the cup rim against the turned over rim of the aperture.

However, this construction and method of charging are by no means ideal from the point of view of cost and leakage. Cost-wise, this conventional method is not ideal because of the large number of parts involved and also because of the not insignificant wastage of propellant left in the cup and in the head cavity, which must of course have a large enough capacity to embrace the collet and the relatively large container aperture. Leakage is a problem because of:

a. the possibility of leakage between the gasket and the plastics parts of the valve;
b. the leakage path between the cup neck and the valve parts; and
c. the large leakage path at the periphery of the cup.

The latter path, as will be apparent, is so constructed that the pressure in the container itself acts to oppose the seal at that path. Moreover, the depth of the rim of the aperture is only about one eighth of an inch (about 3 mm) so that the depth of the seal is relatively small in comparison with the path length of about 3.1 inches (80 mm). Also it is seen that this path is sealed under conditions which are not ideal, i.e. by a collet constrained within the confines of the filling head and needing to operate quickly and efficiently subsequent to the filling with propellant. Moreover, during filling, the rim gasket temperature falls considerably and this can cause the gasket to be detached from its required position. If the charged container is found to be faulty in any respect, normally the complete product must be rejected.

Another method used at the present time uses the same plurality of parts which are completely assembled, with a nozzle, before the propellant is introduced. In this case filling occurs by displacing the nozzle into sealing engagement with the neck of the metal cup and forcing propellant through two holes in the nozzle into the annular gap between the neck and the valve stem. The propellant displaces the gasket from its sealing position to permit the propellant to enter the container. This method, of course, requires a multipart valve structure.

I have already proposed some improvement in U.S. Pat. No. 3,598,324 and No. 3,620,421. In those cases I propose a valve comprising a unitary member having a tubular body portion containing a valve inlet passage, a valve actuating portion defining a valve outlet passage. The controllable flow path of the valve is wholly within the unitary member and has an annular valve seat within the member. In one case the valve seat is engaged by a resilient gasket engaged within an annular cavity of the body portion. A flexible annular wall portion integrally seals the body portion to the actuating portion to allow deflection of the actuating portion relative to the body portion. There is accordingly no leakage path to the outside at a point intermediate the inlet and outlet so that the leakage noted above at (a) is eliminated.

It is an object of the invention to provide improved packaging which according to one aspect of the invention involves an improved method of making a pressurized package which method according to the aforementioned U.S. Pat. No. 3,620,421 includes the steps of: providing a valve comprising a unitary member having a tubular body portion of compressible material containing a valve inlet passage and an actuating portion containing a valve outlet passage, the inlet and outlet of the valve being joined by a controllable flow path extending wholly within the unitary member and incorporating an annular valve seat spaced from the inlet of the valve; providing a container having an aperture defined by a container neck; and sealing the valve member in the neck.

SUMMARY OF THE INVENTION

According to one aspect of the invention, the method is characterized in that the valve body portion and the neck are preformed for an interference fit, including an interference fit between a rib on one of the neck and body portion and a groove in the other, in that the depth of said neck is such that the ratio of the smallest cross-sectional dimension of that neck portion which is in interference with the valve body portion to the depth of the neck portion is no greater than 5, in that said body portion is longer than the neck portion, and in that the valve is sealed in the neck by applying force to the valve in the direction into the neck to force the valve into interference sealing engagement with the neck with an interference fit of the rib in the groove, with the inward end region of the valve body portion projecting into the container and bulging beyond the neck, and with the valve seat being downstream of the inward end of the neck so that the fluid pressure within the container acts radially outwardly within the valve member to force the body portion against the neck portion.

Preferably a dip-tube is fitted onto the inlet prior to aligning the valve so that the dip-tube is held by the compression exerted by the neck portion and provides an outwards reaction assisting in urging the body portion against the neck portion.

Alternatively, the dip-tube may embrace the body portion so that a groove (to be engaged by a rib of the neck) is defined between a reduction in diameter of the body portion and the end of the dip-tube.

It will be apparent that, in accordance with the invention, the conventional mounting cup is no longer required, so that the previously-mentioned leakage possibilities (b) and (c) can be reduced to a single path, leakage possibility (a) being eliminated by the type of valve used. Moreover, this path can be appreciably less than the one-inch (25 mm) conventional path, is preferably less than 0.75 inches (about 19 mm) and may be as small as about one-third inch (about 9 mm) diameter or smaller. Moreover, the leakage path to depth ratio of no more than 5:1 ensures a reasonable sealing area behind the leakage path. Of course the sealing improves as the ratio falls and advantageously the ratio is no greater than 3:1. Indeed in a preferred, fully tested, embodiment the ratio is no greater than 1:1. Commercially acceptable constructions, however, have a much higher ratio than 1:1.

The rib and groove engagement ensures a tight snap-in coupling predetermining the relative positions of the valve and neck to give the desired valve projection into the container. The resulting bulged portion of the valve gives a gas-tight seal at the inner end of the neck. This bulge may be produced by the resilience of the material of the valve body portion and/or by the outward force of a dip-tube forced into the valve body portion. Preferably the neck bites into the valve body portion at the base of the bulge to resist valve removal and to ensure a tight seal.

Preferably the method involves charging the container with fluid under pressure through the aperture and at least partially bypassing the valve, whereafter the valve is forced down into the neck to seal the contents.

According to another aspect of the invention, there is provided a pressurized package, preferably made according to the aforesaid method, and comprising a container having an aperture defined by a neck, and a valve comprising a unitary member having a tubular body portion of compressible material and containing a valve inlet passage and an integral actuating portion containing a valve outlet passage, the inlet and outlet of the valve being joined by a controllable flow path extending wholly within the unitary member and incorporating an annular valve seat spaced from the inlet of the valve, the body portion being preformed for an interference fit with at least a portion of the neck and projecting from the neck into the container and bulging beyond the neck, the ratio of the smallest cross-sectional dimension of the neck portion to the depth of the neck portion is no greater than 5, and the valve seat being downstream of the inward end of the neck so that fluid pressure within the container acts radially outwardly within the valve member in its closed position to force the body portion against the neck portion.

A preferred form of neck is inwardly projecting and comprises a rib or groove and additional wall to be in interference with the valve body portion, the additional wall having a depth at least as great as that of the rib or groove (i.e. the rib or groove width in the direction from the outside to the inside of the container) and at least a portion of the wall being between the rib or groove and the free end of the neck. That end may be turned away from the valve, but in one preferred embodiment is orientated to bite into the valve body portion.

In one possibility the neck portion and body portion are preformed with interfering screw threads so that force on the valve during assembly causes the valve to rotate to enter the neck and adopt its interference position. In preferred embodiments, the valve body portion is of tubular form and itself defines the inlet passage. This avoids a first tube engaged with the neck, a second defining the inlet passage and material joining the two and acting as a diaphragm on which internal pressure acts to apply torque to the outer tube tending to reduce the sealing pressure.

According to another aspect of the invention, there is provided an apparatus for carrying out the aforesaid method, the apparatus comprising a hollow filling head to seal against the aperture of the container wall, means for displacing the head into sealing engagement against said wall, means for introducing fluid under pressure into the head and thence into the container through the aperture, and means for forcing the valve into the aperture to retain the valve therein in sealing interference engagement with the aperture, the forcing means being arranged to act whilst said head is sealed to the container, the forcing means being the sole means for causing the valve to be sealed, the forcing means not relying on material deformation to seal and retain the valve except that it provides on the valve a force solely in the direction into the container aperture as is necessary to create the interference fit between the valve and aperture, i.e. there is no collet to apply radially outward deforming forces. Preferably the head is dimensioned to seal closely about an aperture of no more than about 0.75 inches (19 mm) diameter.

Herein, "unitary" refers to single piece construction or its equivalent, e.g. a construction consisting of glass or plastics pieces fused together to give the effect of a monolithic structure.

DESCRIPTION OF THE DRAWINGS

For a better understanding of the invention and to show how the same may be carried into effect, reference will now be made, by way of example, to the accompanying drawings, in which:

FIG. 1 is a side view of a valve with dip-tube;

FIG. 2 is a cross-section of one form of the valve shown in FIG. 1;

FIG. 3 is a cross-section of another form of the valve shown in FIG. 1;

FIG. 4 is a cross-sectional view of a container suitable for the valves of FIGS. 1 to 3;

FIG. 12 shows a further alternative connection between container and valve;

FIG. 13 shows another arrangement for connecting a valve to a container;

FIG. 14 shows a method of connecting a valve to a container utilising an additional, interposed, member;

DESCRIPTION OF EMBODIMENTS

Figure 5:
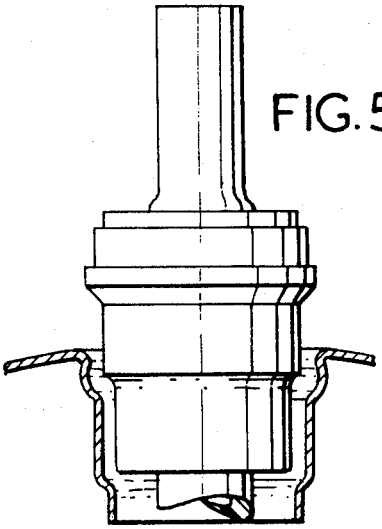
FIG. 5 illustrates the positioning of a valve in the neck of the container of FIG. 4.

FIG. 1 shows a side view of a valve 1 suitable for a pressurized package. The valve comprises a unitary elongate tubular body 2 of circular section defining a valve inlet 3 and a valve outlet 4. A dip-tube 5 is shown fitted into the inlet 3. Wholly within the body is the controllable flow path of the valve, this path extending from the outlet 3 to the inlet 4 without any break in the path, i.e. without any possible leakage path between inlet and outlet.

The body 2 has a portion 6 formed with a rib 7 and a step or shoulder 8, this portion being generally tapered in form because of the two successive reductions in diameter beginning at the rib 7. The portion 6 has an upper annular surface 9.

FIG. 2 shows in cross-section one embodiment of the valve of FIG. 1.

The outlet stem 10 of the valve body extends into the portion 6, being attached thereto by a thin annular integral portion 11 which acts in the manner of a spring and allows the stem 10 to be displaced relative to the portion 6. An annular cavity 13 exists within portion 6 and can communicate with outlet passage 14 by a hole 15 through an annular valve seat 15*a* on a frusto-conical end of stem 10. This hole is normally sealed by an annular rubber gasket 16. On depression of stem 10, gasket 16 deflects to allow fluid to flow from the inlet to the outlet through hole 15. Dip-tube 5 helps to retain gasket 16. The form of this embodiment is the subject of U.S. Pat. No. 3,620,421. The valve body is a single plastics moulding of compressible, resilient, material. Preferably the material of the valve and the thickness of the portion 11 is such that, when subjected to excessive temperature (110°C to 250°C and preferably 120°C to 170°C) the portion 11 will melt to allow the valve to open before an associated container ruptures due to the internal pressure created by that temperature. Thus, if a container with this valve is dropped into a fire, the contents will leak through valve to prevent container rupture. Moreover, in the embodiment of FIG. 2, the gasket may be designed so as to flare or otherwise be displaced to allow leakage of the contents when the internal pressure rises to a value substantially in excess of normal operating pressure but below the pressure at which the container ruptures.

FIG. 3 shows an alternative embodiment of the valve of FIG. 1. The controllable flow path within the portion 6 contains an annular rib or restriction 17 providing the annular valve seat 15*a*. The stem 10 is joined to the portion 6 by an annular flexible portion 11 allowing relative movement between the stem 10 and portion 6. Stem 10 carries a projection 18 having an enlarged end 19 which can be forced beyond rib 17 to engage with its lower side 15*a* to provide a closure position of the valve, maintained by fluid pressure at the inlet and the resilience of portion 11. Depression of stem 10 deflects end 19 away from rib 17 to open the valve. The form of this embodiment is the subject of U.S. Pat. No. 3,598,324. The valve is a single plastics moulding of resilient material.

In all subsequently described embodiments, the valve interior may be according to FIG. 2 or 3.

Suitable materials for the plastics mouldings are polyolefines and copolymers based upon polypropylene, polythene and ionomers such as Surlyn A (DuPont).

It is found that the pressure inside the container, e.g. 40 to 60 p.s.i., and/or the force fit of the dip-tube can contribute substantially to the efficient sealing of the valve to a container, so that there is a wide range of plastics suitable for the valve, subject of course to chemical compatibility with the container contents. Without intending any limitation but by way of example to assist in carrying the invention into effect the following properties are suggested:

Compressive modulus (ASTM-D695)
7000 – 12,000 p.s.i.;
Tensile modulus (ASTM-D638)
7000 – 20,000 p.s.i.;
Flexural modulus (ASTM-D797)
7000 – 30,000 p.s.i.;
Shore value (ASTM-D2246)
55 – 63D;
Tensile Strength (ASTM-D412)
5000 – 6000 p.s.i.;
Bashore Resilience Value
43 – 62%

One suitable material is polyester elastomer such as that sold as Hytrel (DuPont Trade Mark).

FIG. 4 shows in section a container designed to receive the valve of FIG. 1 (and FIG. 2 or 3). It is a three part metal container consisting of a cylindrical part 20 and two end walls 21 and 22 given a curvature by the same tooling. Upper wall 22 has been subjected to additional forming operations to provide it with an inwardly directed neck 23 defining a tubular aperture 24. The neck has a formation shaped and dimensioned to interlock with valve portion 6 with an interference fit. The neck thus has a groove 25, a substantially cylindrical portion 26, a step or shoulder 27 and a substantially cylindrical, reduced diameter, portion 28. The three parts are crimped together. The longer the neck the better the final sealing effect but in this embodiment the neck is shorter than valve portion 6. The inner wall 29 of the neck may be coated with a resilient skin, e.g. formed as a flowed-in gasket or formed by painting on resilient material.

In this embodiment, the diameter at the top of the neck is about 9 mm, the diameter in the groove 25 is about 10 mm, the diameter at the bottom of the neck is about 6.5 mm and the total, vertical, depth of the neck is about 6.5 mm, giving an advantageously low ratio of 1:1 between the smallest diameter and the depth. The valve body portion 6 is similarly formed except that its dimensions radially are slightly larger than those of the neck to achieve an interference fit. Also the portion 6 is about 2.5 to 3 mm longer than the neck.

In a modification of this embodiment, the end wall 22 is integral with cylindrical part 20, e.g. the parts 20 and 22 may be integrally formed by impact extrusion of aluminum.

Figure 6:
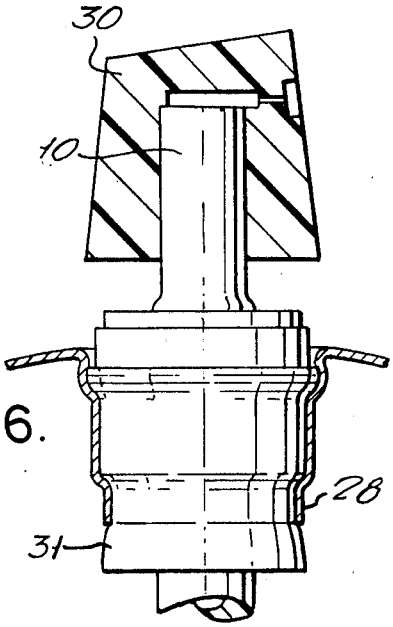
FIG. 6 shows the valve and container neck of FIG. 5 when in interference engagement and FIG. 6A shows in enlarged form a portion of that engagement.
Figure 6A:
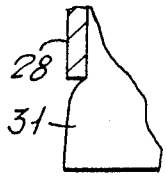

In the final filling and completion of the container, the container is first charged with the product concerned. Then, by means of an apparatus to be described later, propellant is introduced and the container sealed. This is effected by placing the valve loosely in the aperture 24 as shown in FIG. 5, by applying a vacuum to purge the container via the aperture 24, by passing the propellant between the valve body and the aperture and finally by forcing the valve portion 6 into the aperture 24. The final position is shown in FIG. 6, when a nozzle 30 has also been forced onto stem 10. It is particularly pointed out that the lower part of the valve portion 6 projects beyond the end of the neck and because of the pressure of cylindrical portion 28 on the resilient material of the valve forms a bulge 31, shown to an enlarged scale in FIG. 6. The end of the neck bites into this bulge to give a circular gas-tight seal which will tend to increase its sealing effect as the internal pressure of the container rises. The seal is also assisted by the dip-tube.

It is possible so to design the fit between the valve and neck that when a predetermined internal pressure is reached (below the value that would rupture the container but well above normal operating pressures), the valve is forced from the neck. This constitutes a safety feature in that the emission of the valve is considered to be preferable to rupture of the can.

Figure 7:
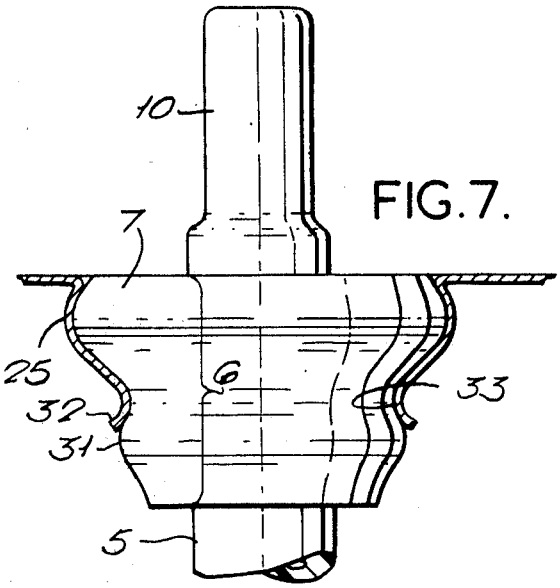
FIG. 7 is a view in partial cross-section showing a modification corresponding to the condition shown in FIG. 6.

FIG. 7 shows an embodiment particularly designed for high pressure release.

In this case the valve portion 6 again has a rib and the neck a corresponding groove 25 to interlock with the rib. Also the neck and valve portion both have a generally tapering form as in the preceding embodiment. A significant difference is the flare 32 at the lower end of the neck so that the sharp edge of this end of the neck no longer tends to bite into the bulge 31. This flare gives the neck a rib 33. A corresponding groove may be preformed in the valve portion 6 but this may be rudimentary to promote the formation of the bulge 31. The afore-mentioned ratio is just less than 2:1 in this case and the smallest diameter is approximately the same as that in the preceding embodiment.

Figure 8:
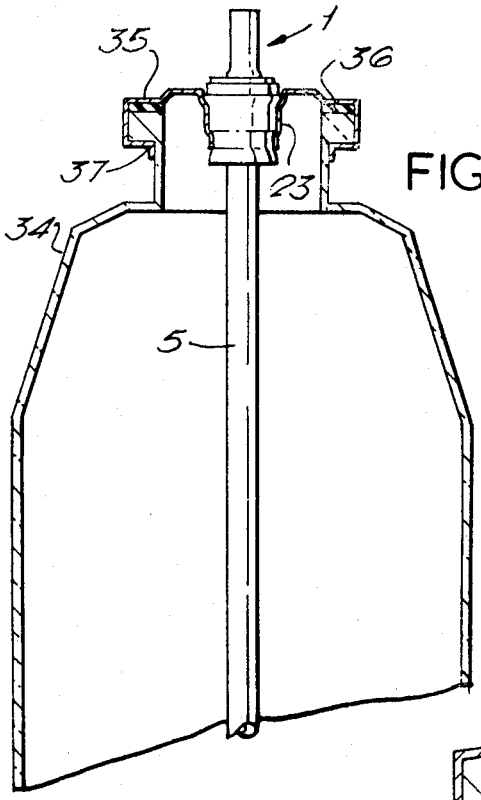
FIG. 8 is a cross-sectional view of a container according to the embodiment of FIGS. 1 to 6 but with a modified container.

FIG. 8 shows an adaption of the embodiment of FIGS. 1 to 6 for a unitary or monolithic container 34 of glass or plastics. The container may be made of two or more pieces fused together but for the purposes of this Specification it is regarded as unitary or monolithic, i.e. as a single piece body, as the fusion of the glass or plastics pieces effectively creates a single piece.

The container 34 has a metal closure 35 formed with the neck 23 in which the valve 1 is an interference fit, as in the preceding embodiments. A resilient gasket 36 is interposed between the container 34 and the closure 35, and the latter is deformed at 37 about the container head to maintain the gasket 36 compressed.

Figure 9:
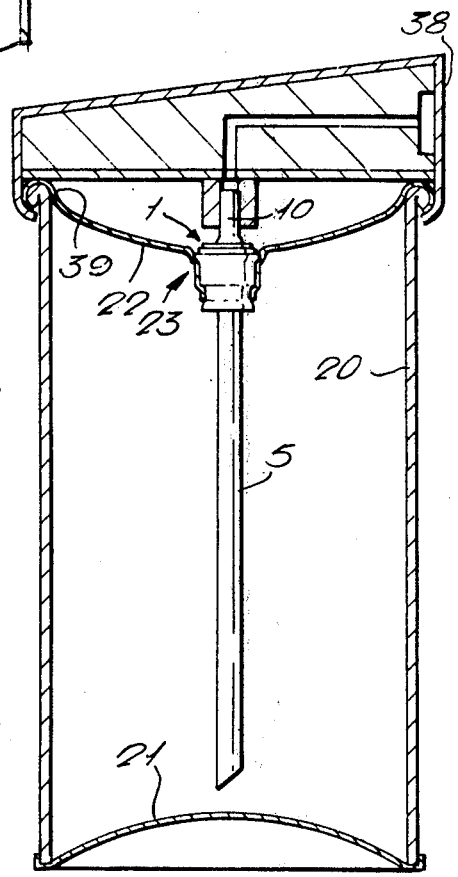
FIG. 9 shows a further modified form of container.

FIG. 9 shows an alternative form of three-piece container to that of FIG. 4. In this case, the end walls 21 and 22 are both concave and are formed on the same tooling, except for the final forming operations on the end 22 to create neck 23. Also, in order to be able to spray over the top of the container, a snap-on nozzle 38 is provided to engage valve stem 10 and clip over the turned-over upper edge 39 of the container.

Figure 10:
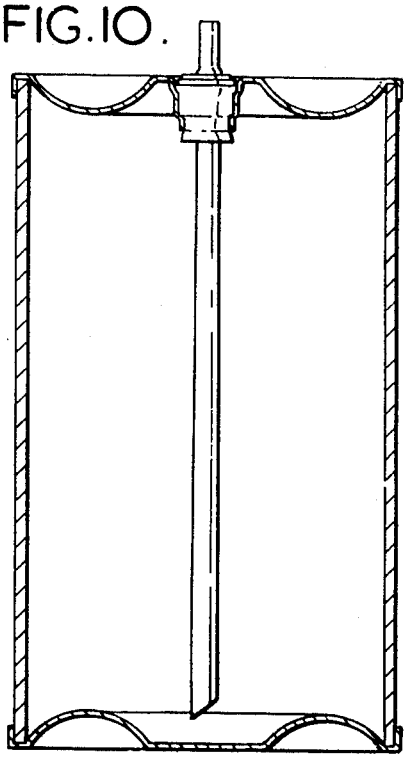
FIG. 10 shows yet another form of container.

FIG. 10 illustrates a double concave version of FIG. 9, avoiding the necessity for a nozzle of the kind shown in FIG. 9.

Figure 11:
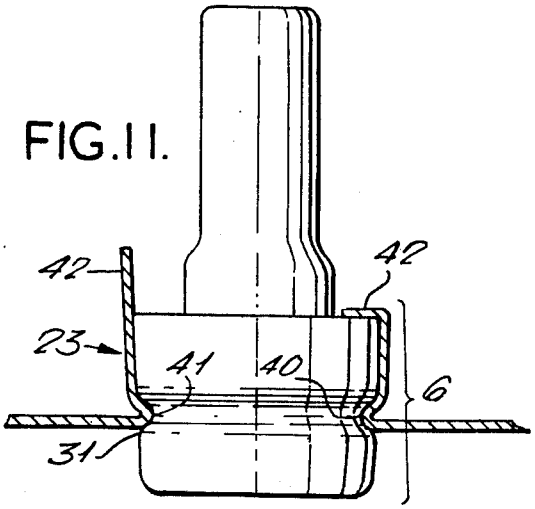
FIG. 11 shows in partial cross-section an alternative means of coupling a valve to a container applicable to any preceding Figure.

FIG. 11 illustrates a further embodiment wherein the valve body has a, possibly vestigial, groove 40 and the neck 23 extends upwardly and has a rib 41. When the valve portion 6 has been forced into the neck, the upper portion 42 of the neck is turned over to assist in retaining the valve (as shown at the right-hand side of FIG. 11).

FIG. 12 shows an alternative formation for the valve body portion 6. In this case, there are two grooves 43 and 44 preformed in the valve body portion 6, one engaged by a rib 45 in the neck and the other engaged by a neck end portion 46. The valve body portion 6 accordingly extends radially beyond the neck where it projects into the container partially due to the preformation and partially due to the pressure on the body portion 6 of the neck end portion 46.

FIG. 13 shows a similar alternative having on the body portion 6 and the rib 7 and the groove 44.

FIG. 14 shows a modification in which the neck is effectively formed by two pieces. The first is a neck member 47 having a portion 48 engaged with interference in the manner of a rib into a groove 49 of the valve body portion, as in the last two modifications. The second piece is a cup-like member 50 which is a force fit with member 47 in a gap 51 between the body portion 6 and the member 47 and is an interference fit with the body portion.

Figure 15:
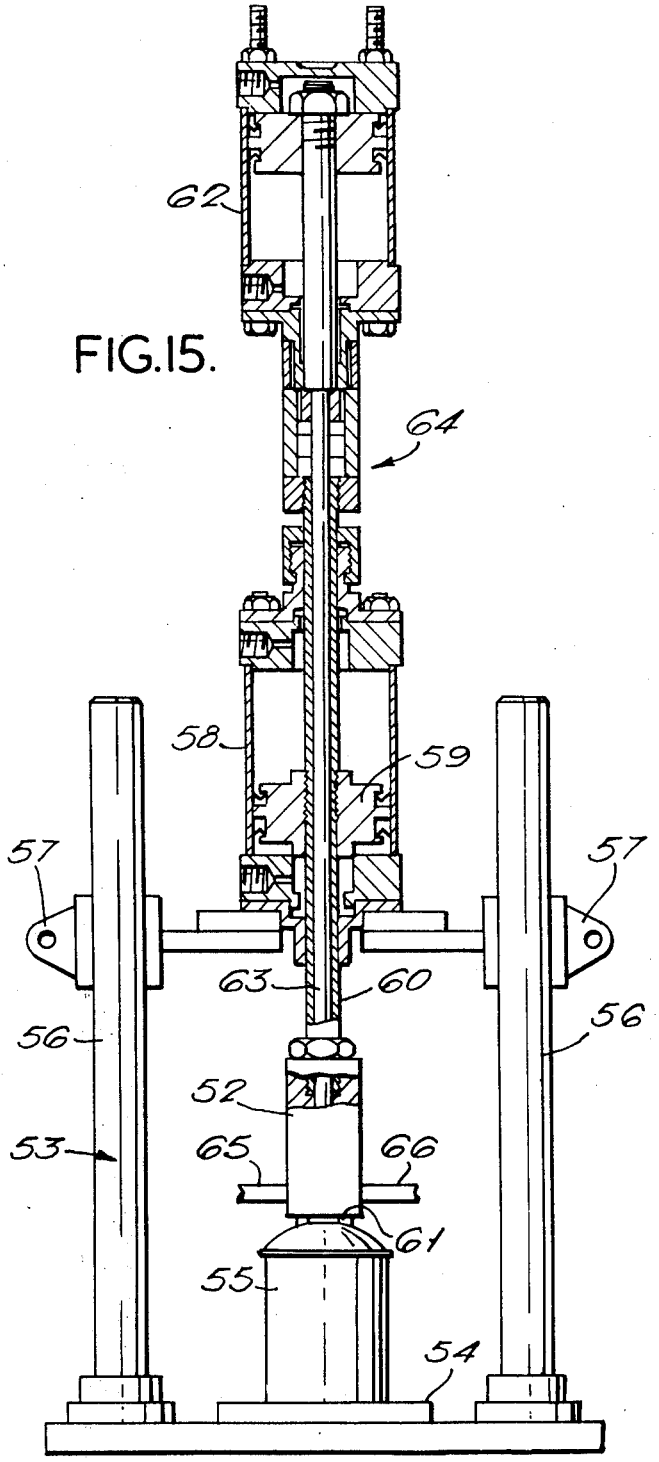
FIG. 15 is an elevational view of a pressurizing and sealing apparatus.
Figure 16:
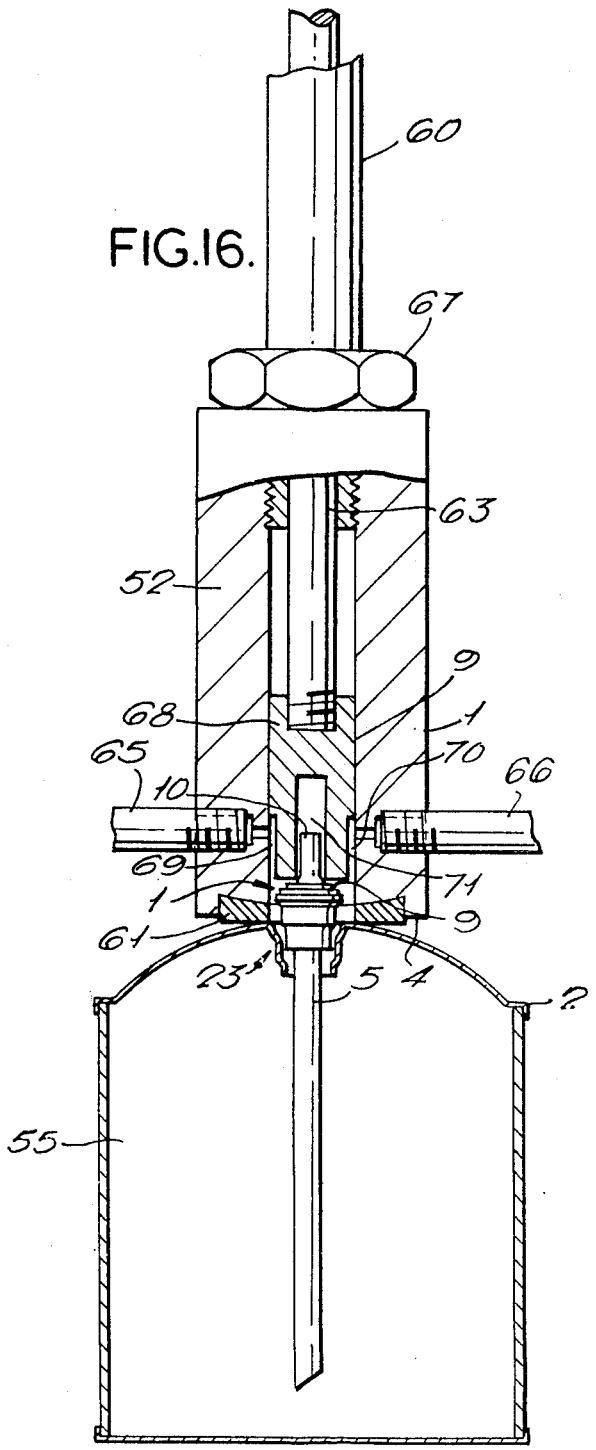
FIG. 16 is a detailed, cross-sectional, view of the apparatus of FIG. 15.

FIGS. 15 and 16 illustrate a filling apparatus defining a single station at which a container, with material to be dispensed therein and loosely carrying a discharge valve, may be supplied around the valve with propellant charge, whereafter the container is closed whilst at said station.

FIG. 15 shows the apparatus in partial cross-section, said apparatus comprising a filling head 52 supported by a stand 53 projecting from a support 54 on which a container 55 to be filled is placed. The stand has supports 56 with sliding adjustments 57 having clamps to maintain a predetermined position of the filling head 52 in relation to the support 54. A pneumatic cylinder 58 contains a piston 59 secured to a tubular shaft 60 attached to the upper end of the filling head 52. At the lower end of the filling head 52 is a resilient annular seal 61 which will be forced into engagement with the upper end of the container 55 by appropriate actuation of the pneumatic cylinder 58. There is also a second pneumatic cylinder 62 fixed to the exterior of the cylinder 58, the second pneumatic cylinder 62 actuating a sliding shaft 63 which passes through the tubular shaft 60 actuated by the cylinder 58. Movement of the two shafts is independent of one another. The adjustments 57 enable the filling head 52 to be driven by the cylinder 58 with a predetermined pressure against the upper end of a container 55 of predetermined dimensions, and there is provision 64 for adjusting the position of the shaft 63 in relation to the cylinder 62. Connections 65 and 66 are provided respectively for a vacuum source and a source of propellant under pressure.

FIG. 16 shows in cross-section the details of the filling head. As FIG. 16 shows, the head 52 is tubular and is screw threaded to the shaft 60, being firmly fixed thereto by means of a nut 67. The shaft 63 passes into the interior of the head 52 wherein it is secured to a piston 68 having slots 69 and 70 in its sides to align (in the position illustrated) with the connections 65 and 66. The piston 68 contains a recess 71 adapted to receive the stem 10 of a valve 1 shown loosely fitted in the neck 23 of the container. The condition illustrated in FIG. 6 is that in which a valve has been loosely placed in the neck 23, the container 55 has been placed on the surface 54 and the cylinder 58 has been operated to force the annular seal 61 into sealing engagement about the neck. It will be appreciated that the inner diameter of the filling head is such as to fit closely around the neck to minimise the internal volume of the head 52. When the illustrated condition has been reached, the vacuum source is operated to withdraw air from the cylinder through the neck 23 and around the valve 1 and through the connection 65. Thereafter propellant is supplied through connection 66 and it is found that it causes the valve 1 to lift away from the neck to allow the appropriate amount of propellant to be introduced into the container. When that amount has been introduced, the cylinder 62 is operated to thrust the rod 63 downwards and thus to move the piston 68 downwardly into engagement with the annular shoulder 9 of the valve, thereby causing the valve to be forced into its sealing position in the neck 23, as illustrated in FIG. 6. It will also be appreciated that the downward movement of the piston 68 seals the apertures leading to the connections 65 and 66. When this process is completed, the filling head is lifted clear of the container by admitting air to the opposite side of the piston in the cylinder 58.

It has been found that, with the machine above, the introduction of the propellant under pressure is sufficient to create the necessary gap between the valve and the neck for the introduction of the propellant into the container. However, if desired, means could be added to the apparatus for elevating the valve from the neck during the charging stage. It is considered, however, that satisfactory results can be achieved merely by resting the valve loosely in the neck. The location of the valve may be facilitated by the tapering form of the neck and/or by the tapering form of the valve. Alternatively, the head may incorporate a collet sliding on a tapered internal face of the head 52 so that the collet parts move inwardly as the piston 68 moves downwardly to grip the valve and locate it in the desired position relative to the piston 68.

In the alternative, the valve may be positioned by first causing the valve to be picked up by its stem by the piston so that it will be withdrawn from the neck by the piston and so that the piston will replace the valve in the correct position subsequent to the charging of the container.

Preferably, the propellant is injected into the container substantially tangentially to its aperture in the neck.

Also, it will be apparent that electrical control means may be utilised to control the sequence of operations, possibly with a pressure-sensitive switch to determine when the filling head 52 is in sealing engagement with the container.

Figure 17:
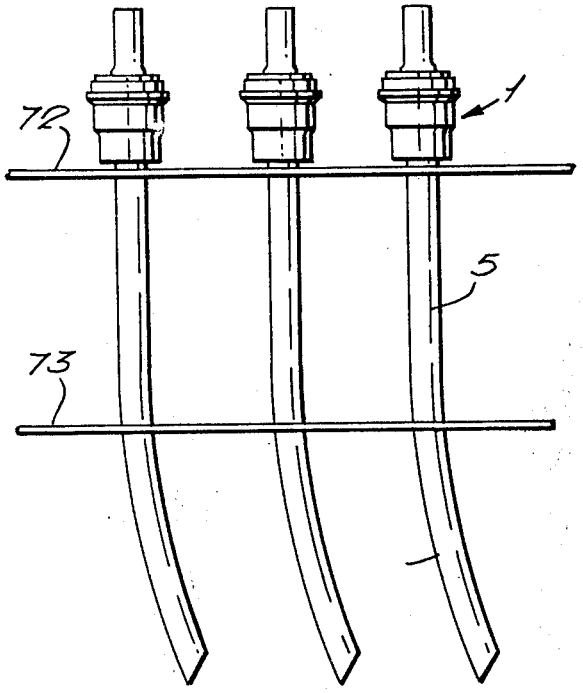
FIG. 17 is a perspective view of a strip of valves.

FIG. 17 shows an arrangement whereby valves 1 can be stored conveniently and be conveyed one-by-one to the station defined by the filling apparatus shown in FIGS. 15 and 16. In this embodiment, a plurality of valves are carried in succession by two strips, tapes or ribbons 72 and 73 in which the dip-tubes 5 are engaged. The tapes 72 and 73 may be of paper or plastics or other suitable flexible material, the tapes having a series of perforations to receive the dip-tubes. The valves thus assembled onto the tapes can be placed into a conventional packaging equipment where they may be despatched to the user. At the point of use, the sorting process is facilitated by simply fitting one end of each tape into a machine which winds these tapes progressively to the filling apparatus.

It is of course feasible to dispense with one of the tapes 72 and 73, for example the tape 73.

Each tape is a tight fit on the dip-tubes and the resulting strip of valves could be wound onto a drum ready for feeding into positioning equipment or could simply be folded into a container for transport. The tape or tapes may have descriptive information placed thereon by printing or other processes. Such information may be the number of valves on a tape and also a description of the valve concerned, e.g. its flow rate, parts type number and so on.

I claim:

1. A method for making a pressurized package comprising the following steps:

supporting a unitary valve member;

supporting a container adjacent the valve member, a neck portion of the container having a preformed surface dimensioned for an interference fit with a mating surface of the valve member;

moving the valve member into engagement with the container neck until:

a. an interference fit is created between annularly continuous rib and groove formations in the preformed surface of the neck and in the mating valve member surface;

b. the inward end portion of the valve member projects into the container and bulges beyond the neck for sealing securement therein; and c. an internal valve seat is disposed downstream of the inward end of the neck thus forcing, in response to radially outward fluid pressure within the container, the surface of the valve member against the mating surface of the neck, which enhances the interference fit;

terminating the movement toward interference fit when the depth of the engagement is such that the ratio of the smallest cross sectional dimension of the neck portion, in interference with the valve member body, to the depth of the neck portion in interference, is no greater than 5:1.

2. The method of claim 1 wherein the step of moving the valve member toward interference fit is further accompanied by the creation of an interference fit between respective cylindrical portions of the preformed neck surface and the mating valve member surface, the cylindrical portions of the valve member and the neck respectively having a depth at least as great as the axial dimension of corresponding rib-groove formations, and wherein the cylindrical surface of the neck is formed between the free end of the neck and the rib and groove formations.

3. The method set forth in claim 1 together with the preparatory step of inserting a dip-tube into an inlet passage of the valve member so that the dip-tube biases the body of the valve against the neck.

4. The method set forth in claim 1 wherein said ratio is no greater than 3:1.

5. The method set forth in claim 1 together with the preparatory steps comprising:

removably affixing a plurality of valve members to a flexible tape; and feeding the flexible tape along a path, adjacent the neck of a container, to be next fitted with a valve member.

6. In a pressurized package including a container having an aperture defined by a neck, in which is sealed a valve including a unitary member, defining a valve inlet and a valve outlet, and having a tubular body portion of resilient material containing a valve inlet passage and an integral actuating portion containing a valve outlet passage, the inlet and outlet of the valve being joined by a controllable flow path extending wholly within the unitary member and incorporating an annular valve seat spaced from the inlet of the valve, the package incorporating improvements comprising:

mating means preformed in the neck for affecting a circumferentially continuous, interference fit seal between the neck and the mating valve body portion;

the body portion projecting and bulging from the neck into the container for securing the body portion in sealing relation to the neck;

the ratio of the smallest cross sectional interference fit dimension of the neck to the interference fit depth of the neck being no greater than 5:1; and the annular valve seat located downstream of the inward end of the neck so that fluid pressure within the container acts radially outwardly within the inlet passage of the valve, in its closed position, to force the valve body portion against the neck.

7. The subject matter set forth in claim 6, wherein the ratio is no greater than 3:1.

8. The subject matter set forth in claim 6 wherein the means for affecting a circumferentially continuous interference fit, between the valve and neck comprises:

mating rib and groove formations; and further wherein juxtaposed cylindrical surface portions are also formed on the valve body portion and the neck, the depth of the juxtaposed cylindrical surface portions being at least as great as the dimension of the rib and groove formations;

and still further wherein the juxtaposed cylindrical surface portions are disposed between the free end of the neck and the rib-groove formations.

9. The subject matter set forth in claim 6 together with a dip-tube received within the inlet passage to bias the valve body portion radially outwardly.

10. A package as claimed in claim 6, wherein the valve body portion and the actuating portion are joined by an integral flexible annular wall having a melting point such that it will melt to expel the pressurized container contents before the temperature of the container rises sufficiently to cause container rupture.

11. A package as claimed in claim 6, wherein the valve member contains a sealing gasket engaging said valve seat the gasket being such that, on a rise in the internal pressure, the gasket will be displaced to release that pressure before it reaches a value sufficient to rupture the container.

12. A package as claimed in claim 6, wherein the interference fit is such that, upon a rising internal pressure, the valve will be emitted from the neck before the container ruptures.

* * * * *